US011221591B2

(12) United States Patent
Nakajima

(10) Patent No.: US 11,221,591 B2
(45) Date of Patent: Jan. 11, 2022

(54) ELECTRONIC TIMEPIECE HAVING A CONDUCTIVE MEMBER SPACED APART FROM A PLANAR ANTENNA

(71) Applicant: Seiko Epson Corporation, Tokyo (JP)

(72) Inventor: Yasuo Nakajima, Matsumoto (JP)

(73) Assignee: Seiko Epson Corporation

( * ) Notice: Subject to any disclaimer, the term of this patent is extended or adjusted under 35 U.S.C. 154(b) by 382 days.

(21) Appl. No.: 16/361,291

(22) Filed: Mar. 22, 2019

(65) Prior Publication Data

US 2019/0294120 A1 Sep. 26, 2019

(30) Foreign Application Priority Data

Mar. 23, 2018 (JP) ..... JP2018-056515

(51) Int. Cl.

| | |
|---|---|
| ***G04G 17/04*** | (2006.01) |
| ***G04G 19/00*** | (2006.01) |
| ***G04R 20/02*** | (2013.01) |
| ***G04R 60/12*** | (2013.01) |

(52) U.S. Cl.

CPC ..... *G04G 17/04* (2013.01); *G04G 19/00* (2013.01); *G04R 20/02* (2013.01); *G04R 60/12* (2013.01)

(58) Field of Classification Search

CPC ..... G04G 17/04; G04G 19/00; G04G 17/06; G04G 21/04; G04R 20/02; G04R 60/12; G04R 60/10; G04R 19/06; G04R 19/065; G04C 10/02; G04C 3/146

USPC ..... 368/47

See application file for complete search history.

(56) References Cited

U.S. PATENT DOCUMENTS

| | | | | |
|---|---|---|---|---|
| 8,072,844 | B2 * | 12/2011 | Miyahara | G04R 60/12 368/47 |
| 10,802,448 | B2 * | 10/2020 | Sawada | G04R 60/12 |
| 2005/0146472 | A1 * | 7/2005 | Ihara | G04G 21/04 343/718 |
| 2015/0378313 | A1 | 12/2015 | Abe et al. | |
| 2016/0161920 | A1 | 6/2016 | Fujisawa et al. | |
| 2017/0040681 | A1 | 2/2017 | Fujisawa | |
| 2017/0261944 | A1 | 9/2017 | Fujisawa | |

FOREIGN PATENT DOCUMENTS

| | | | |
|---|---|---|---|
| JP | S60-143383 | U | 9/1985 |
| JP | 2016-011897 | A | 1/2016 |
| JP | 2016-109522 | A | 6/2016 |
| JP | 2017-037057 | A | 2/2017 |
| JP | 2017-122739 | A | 7/2017 |
| JP | 2017-161338 | A | 9/2017 |

* cited by examiner

*Primary Examiner* — Edwin A. Leon

(74) *Attorney, Agent, or Firm* — Harness, Dickey & Pierce, P.L.C.

(57) ABSTRACT

In an electronic timepiece, a plurality of electric motors, a secondary battery, and a planar antenna are disposed so as not to overlap each other in a plan view when viewed in a direction perpendicular to a dial, in the plan view, a first conductive member and a second conductive member which connect a solar battery and a printed circuit board to each other are disposed in a region different from a region where the planar antenna is disposed when a plane region of the dial is divided into two regions with an imaginary straight line passing through a plane center position of the dial, and the first conductive member and the second conductive member are disposed with a space.

9 Claims, 10 Drawing Sheets

ELECTRONIC TIMEPIECE HAVING A CONDUCTIVE MEMBER SPACED APART FROM A PLANAR ANTENNA

BACKGROUND

1. Technical Field

The present invention relates to an electronic timepiece, and in particular to an electronic timepiece including a solar battery.

2. Related Art

An electronic timepiece including a solar battery and an antenna for receiving radio waves is known (JP-A-2016-109522).

In the electronic timepiece of JP-A-2016-109522, a planar antenna that receives a satellite signal transmitted from a position information satellite, a plurality of electric motors that drive hands, and a secondary battery are disposed so as not to overlap each other in a plan view, thereby thinning the electronic timepiece.

In this electronic timepiece, a solar battery panel is disposed between a dial and a main plate. In order to supply electric power generated by the solar battery panel to the secondary battery, it is necessary to conduct the solar battery panel and a printed circuit board provided with a charge control circuit. In this case, the solar battery panel and the printed circuit board are disposed apart from each other with the main plate interposed therebetween and, in order to make conduction between the solar battery panel and the printed circuit board easy at the time of assembling the electronic timepiece, a solar battery coil spring is used to conduct the solar battery panel and the printed circuit board.

However, the solar battery coil spring needs to have a length corresponding to a height from the solar battery panel to the printed circuit board, and needs to be disposed at a place different in plane position from the planar antenna, the electric motor, and the secondary battery. Furthermore, since the solar battery coil spring is made of metal and current also flows through the solar battery coil spring, there is a possibility that reception performance of the planar antenna may be affected. In addition, the solar battery coil spring may press the solar battery panel and deform the solar battery panel.

SUMMARY

An advantage of some aspects of the invention is to provide an electronic timepiece that can be made thin, and can suppress deterioration of reception performance and deformation of a solar battery panel.

An electronic timepiece according to an aspect of the invention includes an exterior case having a back cover, a hand accommodated in the exterior case, a dial accommodated in the exterior case, a solar battery accommodated in the exterior case and disposed between the dial and the back cover, a planar antenna accommodated in the exterior case and disposed between the dial and the back cover, a plurality of electric motors accommodated in the exterior case, disposed so as not to overlap the planar antenna in a plan view when viewed in a direction perpendicular to the dial, and driving the hand, a secondary battery accommodated in the exterior case, disposed so as not to overlap the planar antenna and the plurality of electric motors in the plan view, and charged by the solar battery, a printed circuit board accommodated in the exterior case and disposed between the solar battery and the back cover, and a first conductive member and a second conductive member which connect the solar battery and the printed circuit board to each other, and are disposed with a space in a region different from a region where the planar antenna is disposed in a case where a plane region of the dial is divided into two regions with an imaginary straight line passing through a plane center position of the dial.

According to the aspect of invention, since the electric motors, the secondary battery, and the planar antenna are disposed so as not to overlap each other in a plan view of the electronic timepiece, a thickness of the electronic timepiece can be reduced. Further, when the plane region of the dial is divided into two regions, the planar antenna is disposed in one region and the conductive member is disposed in the other region and thus, the conductive member which is made of metal can be disposed apart from the planar antenna. For that reason, the influence of the conductive member on the planar antenna can be reduced and deterioration of the reception performance can be suppressed.

Furthermore, since the first conductive member and the second conductive member are disposed with a space therebetween, as compared with the case where respective conductive members are disposed adjacent to each other, the influence on the planar antenna can be distributed, variations in characteristics of the planar antenna can be reduced, and reception in all directions can be made easy.

In addition, since the conductive members are disposed with a space therebetween, in a case where the conductive member is configured by a coil spring, it is possible to distribute the load applied to the solar battery from the coil spring and to suppress deformation of the solar battery and the like.

In the electronic timepiece according to the aspect of the invention, it is preferable that the first conductive member and the second conductive member are disposed such that an angle between the first conductive member and the second conductive member with respect to the plane center position in the plan view is 40 degrees or more and 80 degrees or less.

In the electronic timepiece according to the aspect of the invention, it is preferable that the secondary battery is disposed in a region different from a region where the planar antenna is disposed, in the plan view.

According to the aspect of invention with this configuration, a secondary battery which is made of metal can be disposed apart from the planar antenna, the influence of the secondary battery on the planar antenna can be reduced, and the deterioration in reception performance can be further prevented.

In the electronic timepiece according to the aspect of the invention, it is preferable that, in the plan view, when the plane region of the dial is divided into four regions of a first region to a fourth region with a first imaginary straight line and a second imaginary straight line passing through the plane center position of the dial and orthogonal to each other, the planar antenna is disposed so as to overlap the adjacent first region and second region, the first conductive member is disposed in the third region, and the second conductive member is disposed in the fourth region.

According to the aspect of invention with this configuration, each conductive member can be disposed apart from the planar antenna, and the conductive members can be disposed apart from each other. Accordingly, it is possible to prevent deterioration of the reception performance of the planar antenna and to distribute the load on the solar battery.

In the electronic timepiece according to the aspect of the invention, it is preferable that the first region is disposed in a range from 9 o'clock to 12 o'clock of the dial, the second region is disposed in a range from 12 o'clock to 3 o'clock of the dial, the third region is disposed in a range from 3 o'clock to 6 o'clock of the dial, and the fourth region is disposed in a range from 6 o'clock to 9 o'clock of the dial.

In the electronic timepiece according to the aspect of the invention, it is preferable that the planar antenna includes a power feeding portion disposed in the first region in the plan view, and a reception IC for the planar antenna is disposed in the first region in the plan view.

According to the aspect of invention with this configuration, since the power feeding portion of the planar antenna and the reception IC for a receiving antenna can be disposed in the same first region, a wiring connecting the power feeding portion and the reception IC to each other can be shortened and the influence of noise can be reduced. In particular, since the power feeding portion and the reception IC are disposed in the same region, it is easy to dispose wirings linearly, and the influence of noise can be minimized.

In the electronic timepiece according to the aspect of the invention, it is preferable that the planar antenna is a patch antenna.

Although a patch antenna is a flat-plate type antenna and is known to have single directivity and narrow directivity, since the printed circuit board on which the patch antenna is mounted has a function of a ground plate, radio waves incident from the outside can be reflected on the printed circuit board and guided to the antenna. Accordingly, the antenna can receive radio waves directly incident onto the antenna, as well as radio waves reflected from the printed circuit board and indirectly incident onto the antenna. Accordingly, if the patch antenna is used, the reception performance of the antenna can be further improved.

In the electronic timepiece according to the aspect of the invention, it is preferable that the solar battery includes eight or more cells connected in series.

If eight solar cells are connected in series, an electromotive voltage of approximately 4.8 V or more can be obtained. Accordingly, it is possible to charge a lithium ion secondary battery having a large electromotive voltage, and it is possible to incorporate a device with large current consumption such as a GPS receiving device (GPS module) including the planar antenna and the reception IC.

In the electronic timepiece according to the aspect of the invention, it is preferable that a cover member that covers an outer periphery of the dial is further provided in the plan view, and the first conductive member and the second conductive member are disposed respectively at positions overlapping the cover member in the plan view.

The electrode terminals of the solar battery panel may become conspicuously black as compared with other places because the conductive members are disposed on the back side. Even in this case, since an electrode terminal portion can be concealed by the cover member, a high-quality electronic timepiece can be easily realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, an electronic timepiece 1 of a first embodiment will be described with reference to the drawings. In this embodiment, description will be made on the assumption that a cover glass 31 side of the electronic timepiece 1 is a front surface side (upper side) and the back cover 12 side is a back surface side (lower side).

As will be described later, the electronic timepiece 1 of this embodiment is configured to receive satellite signals from position information satellites S such as a plurality of GPS satellites or quasi-zenith satellites orbiting the earth over a predetermined orbit and acquire satellite time information, and correct internal time information. Furthermore, as satellite signal reception processing, in addition to a manual reception function of starting reception by operating a button by the user, the electronic timepiece 1 has an automatic reception function of automatically starting reception when a predetermined condition is satisfied.

Figure 1:
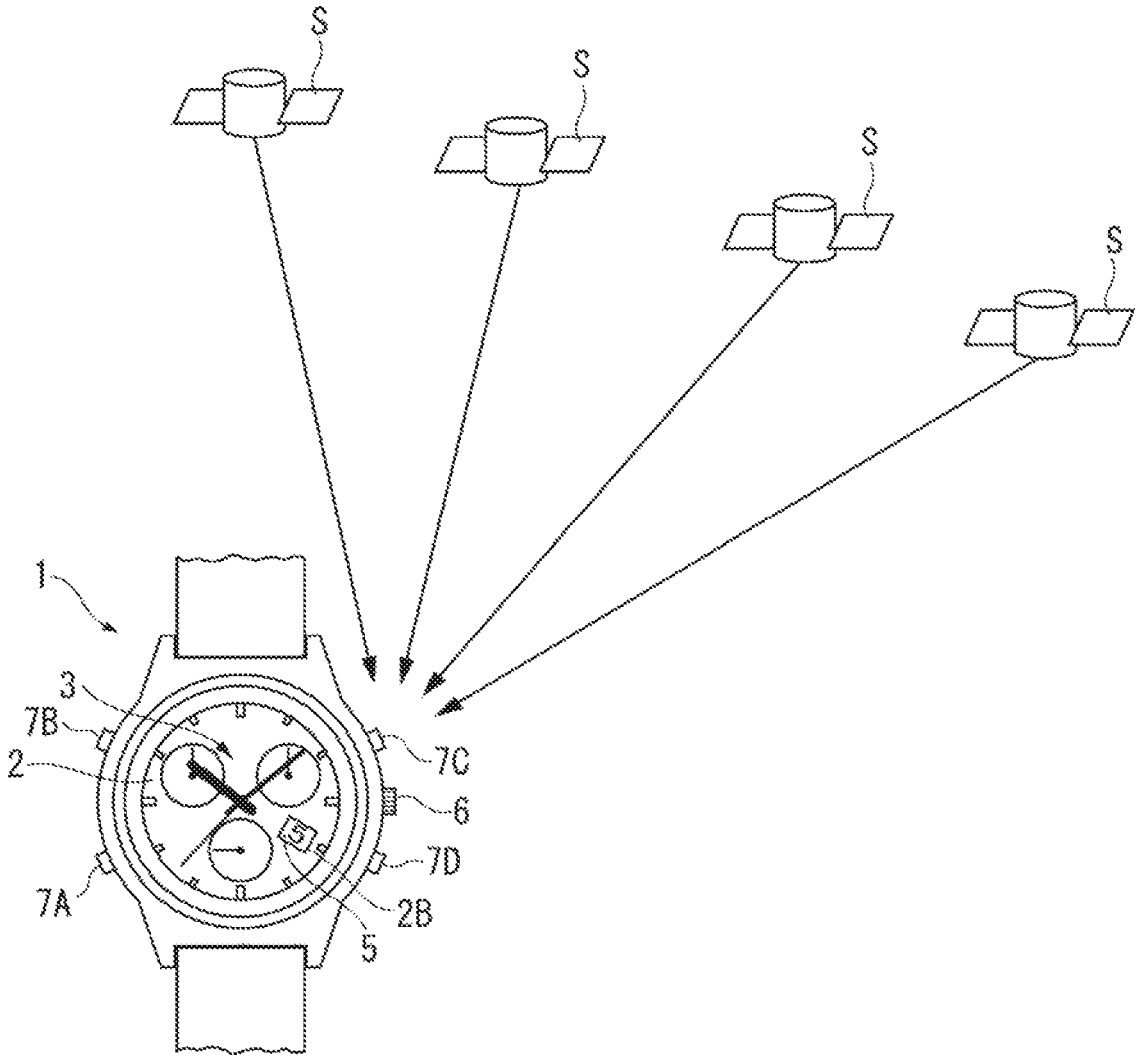
FIG. 1 is a schematic diagram illustrating an electronic timepiece according to a first embodiment.
Figure 2:
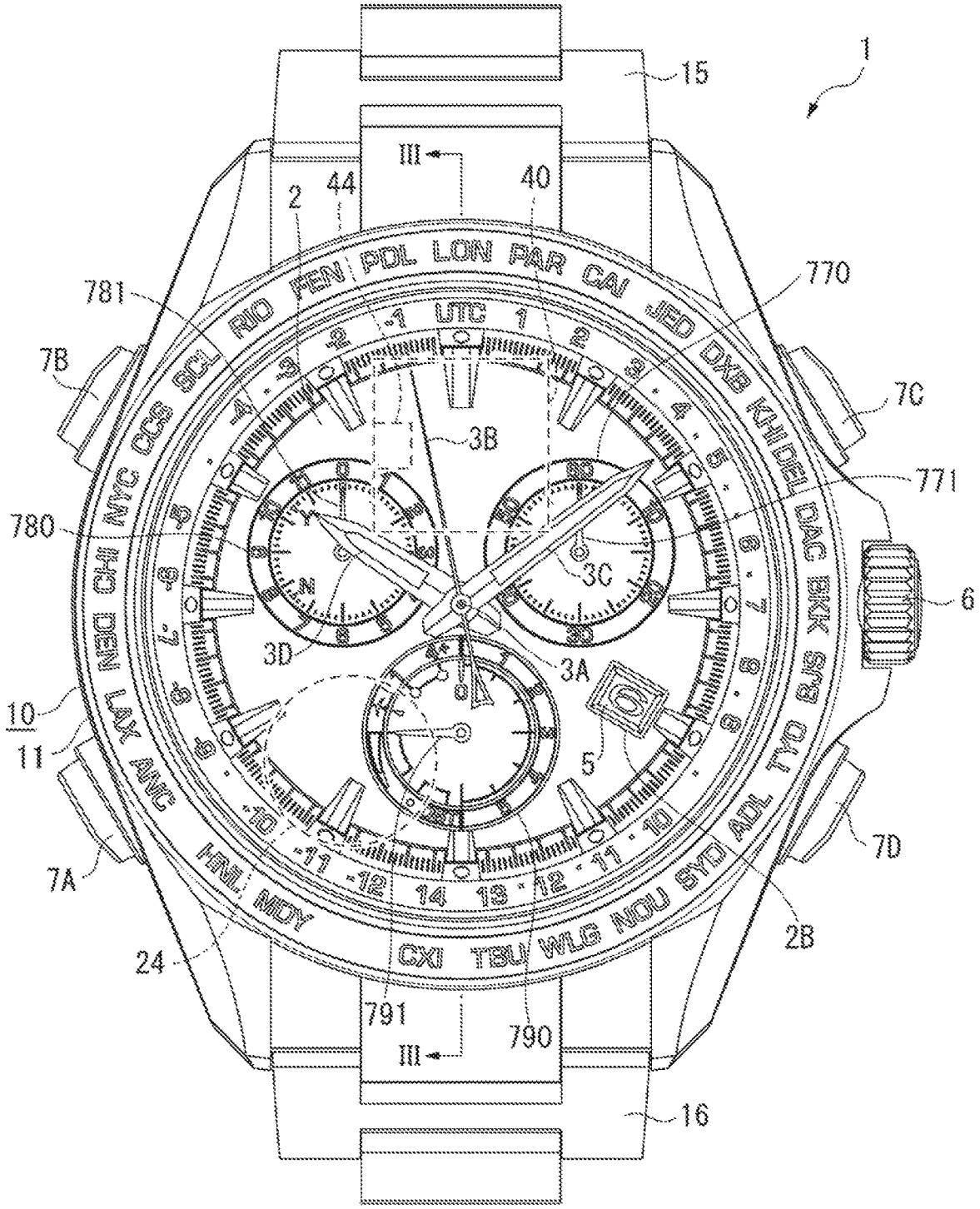
FIG. 2 is a front view illustrating a front surface side of the electronic timepiece.
Figure 3:
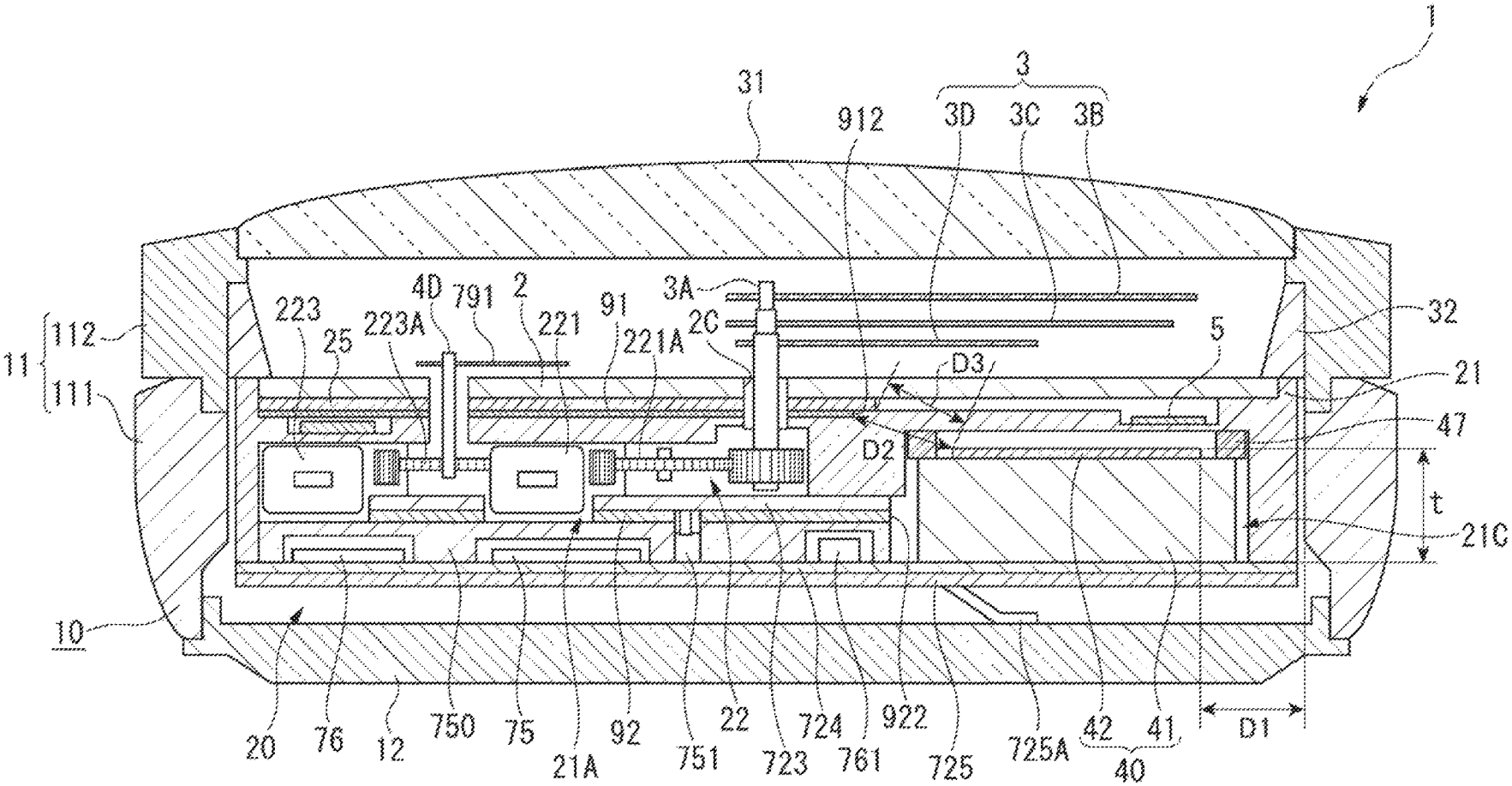
FIG. 3 is a cross-sectional view of the electronic timepiece.

As illustrated in FIGS. 1 to 3, the electronic timepiece 1 includes an exterior case 10 that accommodates a dial 2, a movement 20, a planar antenna 40, a secondary battery 24, and the like. The electronic timepiece 1 includes a crown 6 for external operation, four buttons 7A, 7B, 7C, and 7D, and bands connected to the exterior case 10. The bands include a first band 15 connected to 12 o'clock side of the exterior case 10, a second band 16 connected to 6 o'clock side, and a clasp (not illustrated). The first band 15 and the second band 16 are metal bands having metallic end pieces such as titanium and the like attached to the exterior case 10 and a plurality of pieces. The bands are not limited to metal bands, but may be leather bands, resin bands, or the like.

The dial 2 is formed in a disk shape with a non-conductive member such as polycarbonate. A hand shaft 3A is disposed at a plane center of the dial 2, and hands 3 (second hand 3B, minute hand 3C, and hour hand 3D) are attached to the hand shaft 3A.

The dial 2 has three small windows (sub-dial). That is, as illustrated in FIG. 2, with respect to the plane center where the hand shaft 3A of the dial 2 is provided, a circular first small window 770 and a hand 771 are provided in 2 o'clock direction, and a circular second small window 780 and a hand 781 are provided in 10 o'clock direction, and a circular third small window 790 and a hand 791 are provided in 6 o'clock direction.

A rectangular date window 2B is provided in 4 o'clock direction with respect to the plane center of the dial 2. As illustrated in FIG. 3, a date indicator 5 is disposed on the back side of the dial 2, and the date indicator 5 is visible from the date window 2B. Furthermore, a through-hole 2C through which the hand shaft 3A is inserted and a through-hole through which the hand shaft of the hands 771, 781, and 791 are inserted are also formed in the dial 2.

In this embodiment, the hand 771 of the first small window 770 is a chronograph minute hand and the hand 781 of the second small window 780 is a ⅕ chronograph second hand. The hand 791 of the third small window 790 also serves as a mode hand and a chronograph hour hand. When the hand 791 is used as the mode hand, the hand 791 displays setting of the daylight saving time (DST: daylight saving time ON, o: daylight saving time OFF), a power indicator indicating the remaining amount of the secondary battery 24, and settings of modes of in-flight mode, a timekeeping mode in which GPS time information is received and the internal time is corrected, a positioning mode in which the GPS time information and the orbit information are received and the internal time and the time zone are corrected.

The second hand 3B, the minute hand 3C, the hour hand 3D, the hands 771, 781, and 791, and the date indicator 5 are driven through a step motor and a train wheel which will be described later.

Exterior Structure of Electronic Timepiece

As illustrated in FIGS. 2 and 3, the electronic timepiece 1 includes the exterior case 10 that accommodates the movement 20 and the like, which will be described later. FIG. 3 is a cross-sectional view taken along line III-III connecting 6 o'clock position and 12 o'clock position of the dial 2.

The exterior case 10 includes a case main body 11, a back cover 12, and a cover glass 31. The case main body includes a cylindrical case band 111 and a bezel 112 provided on a front surface side of the case band 111.

On the back surface side of the case main body 11, a disk-shaped back cover 12 that closes the opening on the back surface side of the case main body 11 is provided. The back cover 12 is connected to the case band 111 of the case main body 11 by a screw structure. In this embodiment, the case band 111 and the back cover 12 are formed as separate bodies, but is not limited thereto. One-piece case in which the case band 111 and the back cover 12 are integrated may be adopted.

Metal materials such as stainless steel (SUS), titanium alloy, aluminum, brass (BS), and the like are used for the case band 111, the bezel 112, and the back cover 12.

Internal Structure of Electronic Timepiece

Next, an internal structure built in the exterior case 10 of the electronic timepiece 1 will be described.

As illustrated in FIG. 3, in addition to the dial 2, the movement 20, the planar antenna (patch antenna) 40, the date indicator 5, a dial ring 32, and the like are accommodated in the exterior case 10.

The movement 20 includes a main plate 21, a train wheel bridge (not illustrated), a driving body 22 supported by the main plate 21 and the train wheel bridge, a first printed circuit board 723, a second printed circuit board 724, the secondary battery 24, a solar battery panel 25, a first magnetic shield plate 91, and a second magnetic shield plate 92.

The main plate 21 is formed of a non-conductive member such as plastic. The main plate 21 includes a driving body accommodation portion 21A for accommodating the driving body 22, a date indicator disposition portion 21B on which the date indicator 5 is disposed, and an antenna accommodation portion 21C for accommodating the planar antenna 40.

The driving body accommodation portion 21A and the antenna accommodation portion 21C are provided on the back surface side of the main plate 21. Since the plane position of the antenna accommodation portion 21C is 12 o'clock position of the dial 2, as illustrated in FIG. 2, the planar antenna 40 is disposed at 12 o'clock position. Specifically, the planar antenna 40 is disposed between the hand shaft 3A of the hand 3 and the case main body 11, and is disposed in a range from approximately 11 o'clock position of to approximately 1 o'clock position of the dial 2. That is, the center position of the planar antenna 40 is disposed within an angular range of 60 degrees from 11 o'clock direction to 1 o'clock direction with respect to the plane center of the exterior case 10 (center of the dial 2).

Figure 4:
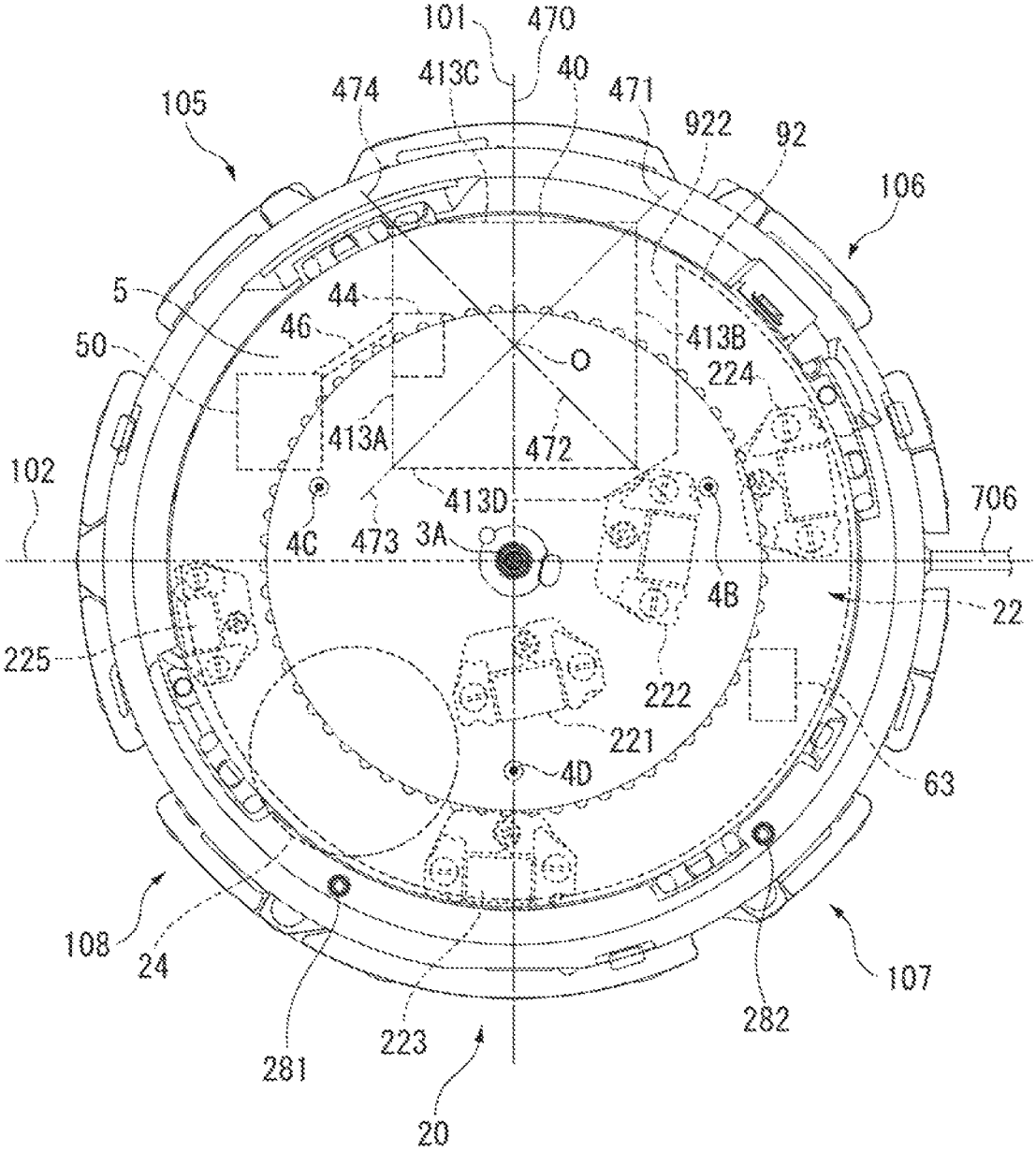
FIG. 4 is a plan view illustrating a main part of a movement of the electronic timepiece.

The driving body 22 is accommodated in the driving body accommodation portion 21A of the main plate 21 and drives the second hand 3B, the minute hand 3C, the hour hand 3D, and the hands 771, 781, and 791 and the date indicator 5. That is, as illustrated in FIG. 4, the driving body 22 includes a first step motor 221 and a first train wheel 221A for driving the second hand 3B (FIG. 3), a second step motor 222 and a second train wheel (not illustrated) for driving the minute hand 3C and the hour hand 3D and, a third step motor 223 and a third train wheel 223A (FIG. 3) which are used for driving the hand 791 and the date indicator 5. The third train wheel 223A has a date indicator driving wheel 228 (FIG. 5) that rotates the date indicator 5.

Furthermore, the driving body 22 has a fourth step motor 224 and a fourth train wheel (not illustrated) for driving the hand 771, a fifth step motor 225 and a fifth train wheel (not illustrated) for driving the hand 781.

The step motors 221 to 225 are disposed in a region that does not planarly overlap the planar antenna 40 and the secondary battery 24. A hand shaft 4B to which the hand 771 is attached, a hand shaft 4C to which the hand 781 is attached, and a hand shaft 4D to which the hand 791 is attached are disposed on the inner peripheral side of the date indicator 5, respectively.

As illustrated in FIG. 4, in the movement 20, in a plan view when seen in a direction perpendicular to the dial 2, a winding stem 706 connected to the crown 6 is disposed at 3 o'clock position of the dial 2 and a switch mechanism (switching mechanism) (not illustrated) such as a setting lever or the like is disposed around the winding stem 706.

Magnetic Shield Plate

In recent years, a high-performance magnet is often used in a case for a mobile terminal such as a smartphone, and a wristwatch is also required to have a magnetic shield property. For that reason, in order to bypass an external magnetic field and prevent erroneous operation of the step motors 221 to 225, as illustrated in FIG. 3, the first magnetic shield plate 91 made of a high permeability material such as pure iron and the second magnetic shield plate 92 are disposed at positions planarly overlapping the step motors 221 to 225. Each of the step motor 221 to 225 includes a coil wound around a core, a stator, and a rotor. Among the coil, the stator, and the rotor, since the coil portion is not easily affected by the external magnetic field, the coil portion is not necessarily required to overlap the magnetic shield plates 91 and 92 in a plan view. Accordingly, the magnetic shield plates 91 and 92 planarly overlap at least a part of the step motors 221 to 225, and particularly preferably planarly overlap the stator and the rotor.

As illustrated in FIG. 3, the first magnetic shield plate 91 is on a timepiece surface side (cover glass 31 side) of the main plate 21 and the date indicator 5, and is disposed on the back surface side of the solar battery panel 25. The magnetic shield plate 91 is disposed so as to substantially cover the front surface (surface on the dial 2 side) of the step motors 221 to 225.

On the first magnetic shield plate 91, an opening portion formed at a position corresponding to the date window 2B so that the date indicator 5 can be visually recognized and an opening portion where the hand shafts 3A, 4B, 4C, and 4D are disposed are formed.

In the first magnetic shield plate 91, a region overlapping the planar antenna 40 in a plan view is cut out to form a cutout portion 912. For that reason, the magnetic shield plate 91 is not disposed on the front surface side of the planar antenna 40, and the planar antenna 40 can receive radio waves through the cutout portion 912 of the magnetic shield plate 91.

As illustrated in FIG. 3, the second magnetic shield plate 92 is on the timepiece back surface side (back cover 12 side) of the main plate 21, and is disposed closer to the timepiece surface side than to the second printed circuit board 724. Specifically, a train wheel bridge (not shown) having bearings of each train wheel is disposed on the timepiece back surface side of the main plate 21, and the second magnetic shield plate 92 is disposed on the timepiece back surface side of the train wheel bridge. The second magnetic shield plate 92 is disposed so as to substantially cover the back surface (surface on the back cover 12 side) of the step motors 221 to 225.

Here, as illustrated in FIG. 4, the movement 20 is virtually divided into four regions in a plan view. Specifically, a first straight line 101 in a 12 o'clock-6 o'clock direction passing through the plane center (plane center position of the exterior case 10 and the dial 2 and the center of the hand shaft 3A) of the movement 20 and the center of the planar antenna 40 and a second straight line 102 in a 3 o'clock-9 o'clock direction which is orthogonal to the first straight line 101 and passes through the plane center of the movement 20 virtually divide the movement 20, that is, the inside of the exterior case 10 into four regions 105 to 108.

The first region 105 is the upper left in FIG. 4, that is, a range from 9 o'clock to 12 o'clock of the dial 2, and the second region 106 is the upper right in FIG. 4, that is, a range from 12 o'clock to 3 o'clock of the dial 2. The third region 107 is the lower right in FIG. 4, that is, a range from 3 o'clock to 6 o'clock of the dial 2, and the fourth region 108 is the lower left in FIG. 4, that is, a range from 6 o'clock to 9 o'clock of the dial 2.

The second magnetic shield plate 92 is formed with a cutout portion 922 so as not to interfere with the planar antenna 40, and is formed so as not to overlap the planar antenna 40 in a plan view. For that reason, in the second region 106, the second magnetic shield plate 92 is shaped to cover a portion not overlapping the planar antenna 40, and a portion extending from the third region 107 to the fourth region 108 is formed in a substantially semicircular shape. Accordingly, the second magnetic shield plate 92 does not cover the first region 105 by the cutout portion 922.

In the first region 105, as will be described later, a power feeding portion 44 of the planar antenna 40 and a reception unit (reception IC) 50 are disposed. On the other hand, in the first region 105, the step motors 221 to 225 and a crystal oscillator 63 are not disposed.

In the second magnetic shield plate 92, an opening portion where the coils of the step motors 221 to 224 are disposed and a substantially circular cutout portion where the secondary battery 24 is disposed are formed.

In a case where the movement 20 is virtually divided into two regions (first region 105 and second region 106, and third region 107 and fourth region 108) by the second straight line 102, the planar antenna 40 and the secondary battery 24 are disposed in different regions. Accordingly, in this embodiment, the second straight line 102 is an imaginary straight line dividing the plane region of the dial 2 into two regions. Also, the first straight line 101 is the first imaginary straight line and the second straight line 102 is the second imaginary straight line.

Printed Circuit Board

Figure 5:
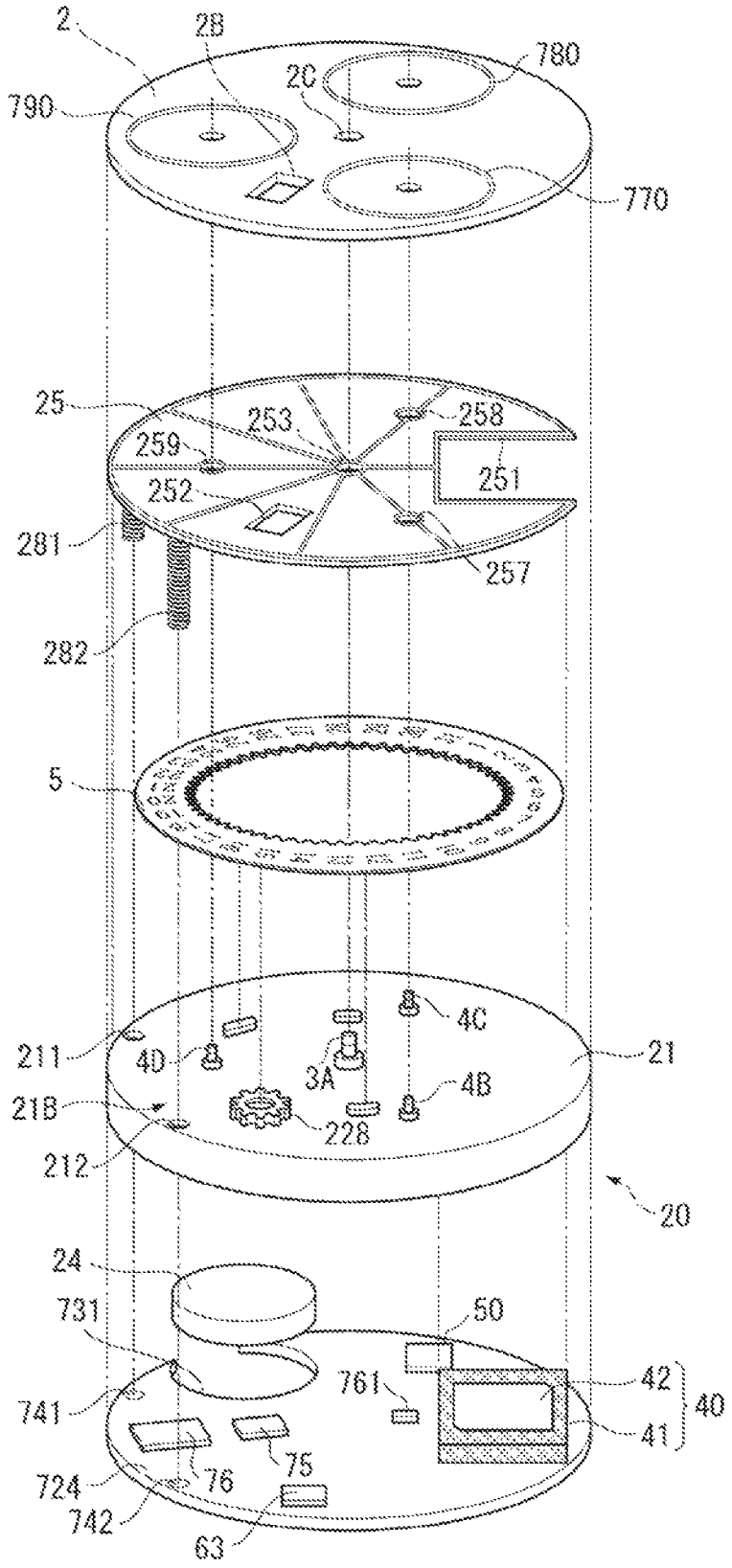
FIG. 5 is an exploded perspective view illustrating the main part of the movement of the electronic timepiece.

In the electronic timepiece 1 of this embodiment, two circuit boards of the first printed circuit board 723 (not illustrated in FIG. 5) for timepiece drive control illustrated in FIG. 3 and the second printed circuit board 724 for GPS reception illustrated in FIGS. 3 and 5 are disposed.

The first printed circuit board 723 is disposed between the main plate 21 and the second magnetic shield plate 92, and is provided with wirings or the like which conducts to the coils of the step motors 221 to 225, and is connected to the second printed circuit board 724 through a conductive connector 751.

On the first printed circuit board 723, a timepiece control IC (CPU) (not illustrated) for receiving a signal from the second printed circuit board 724 for reception and controlling the electric motor, a timepiece drive control IC (drive circuit) (not illustrated), and the like are mounted.

The second printed circuit board 724 is disposed on the back surface of the second magnetic shield plate 92 through a spacer 750 (not illustrated in FIG. 5). Also, as illustrated in FIG. 5, the second printed circuit board 724 is formed in a substantially circular planar shape and has a substantially circular cutout portion 731 in which the secondary battery 24 is disposed. By disposing the secondary battery 24 in the cutout portion 731, the thickness of the electronic timepiece 1 can be reduced. On the front surface side of the second printed circuit board 724, the planar antenna (patch antenna) 40, the reception unit 50 (reception element, reception IC, and GPS module) for processing satellite signals received from the GPS satellites S, an IC for power supply 75, an IC for memory 76, a chip element 761, the crystal oscillator 63, and the like are mounted. The IC for memory 76 is configured by a flash memory and stores a program of firmware for GPS reception and time zone data for discriminating a time zone from position information calculated in positioning reception processing.

The spacer 750 protects each IC and the like. In this case, it is desirable that the ICs are disposed at positions different from at least directly under the hand shafts 3A, 4B, 4C, and 4D. On the back surface of the second printed circuit board 724, a circuit pressing plate 725 is disposed.

A back cover conducting spring 725A for conducting to the back cover 12 is integrally formed on the circuit pressing plate 725. A plurality of the back cover conducting springs 725A are formed on the circuit pressing plate 725.

Secondary Battery

As illustrated in FIG. 5, the secondary battery 24 is a button type lithium ion battery formed in a circular planar shape, and supplies electric power to the driving body 22, the reception unit 50, and the like. The secondary battery 24 is provided in the cutout portion 731 of the second printed circuit board 724, and is disposed at a position not overlapping the planar antenna 40, the reception unit 50, and the power supply IC 75, specifically, in 8 o'clock direction with respect to the plane center of the dial 2, in a plan view.

A battery terminal plate (not illustrated) is disposed on the back cover side of the secondary battery 24, and the battery terminal plate is electrically connected to the second printed circuit board 724.

Solar Battery Panel

The solar battery panel 25 has a front surface electrode and a back surface electrode as electrode parts. The surface electrode is formed of a transparent electrode such as an indium tin oxide (ITO) for transmitting light. A thin film of an amorphous silicon semiconductor is formed as a power generation layer on a base composed of a resin film.

A frequency of the GPS satellite signal is approximately 1.5 GHz, which is a high frequency. Unlike longwave standard radio waves received by a radio wave timepiece, radio waves with high frequency attenuate even with a thin transparent electrode of a solar panel, and antenna characteristics deteriorate. For that reason, as illustrated in FIG. 5, in the solar battery panel 25 formed in a disk shape, a cutout portion 251 is formed in a portion overlapping the planar antenna 40 in a plan view. The solar battery panel 25 is disposed on the front surface side of the main plate 21 and is not disposed on the front surface side of the planar antenna 40. Accordingly, the planar antenna 40 can receive radio waves through the cutout portion 251 of the solar battery panel 25.

In the solar battery panel 25, there are formed an opening 252 that planarly overlaps the date window 2B of the dial 2 and holes 253, 257, 258, and 259 through which the hand shafts 3A, 4B to 4D are inserted.

Figure 6:
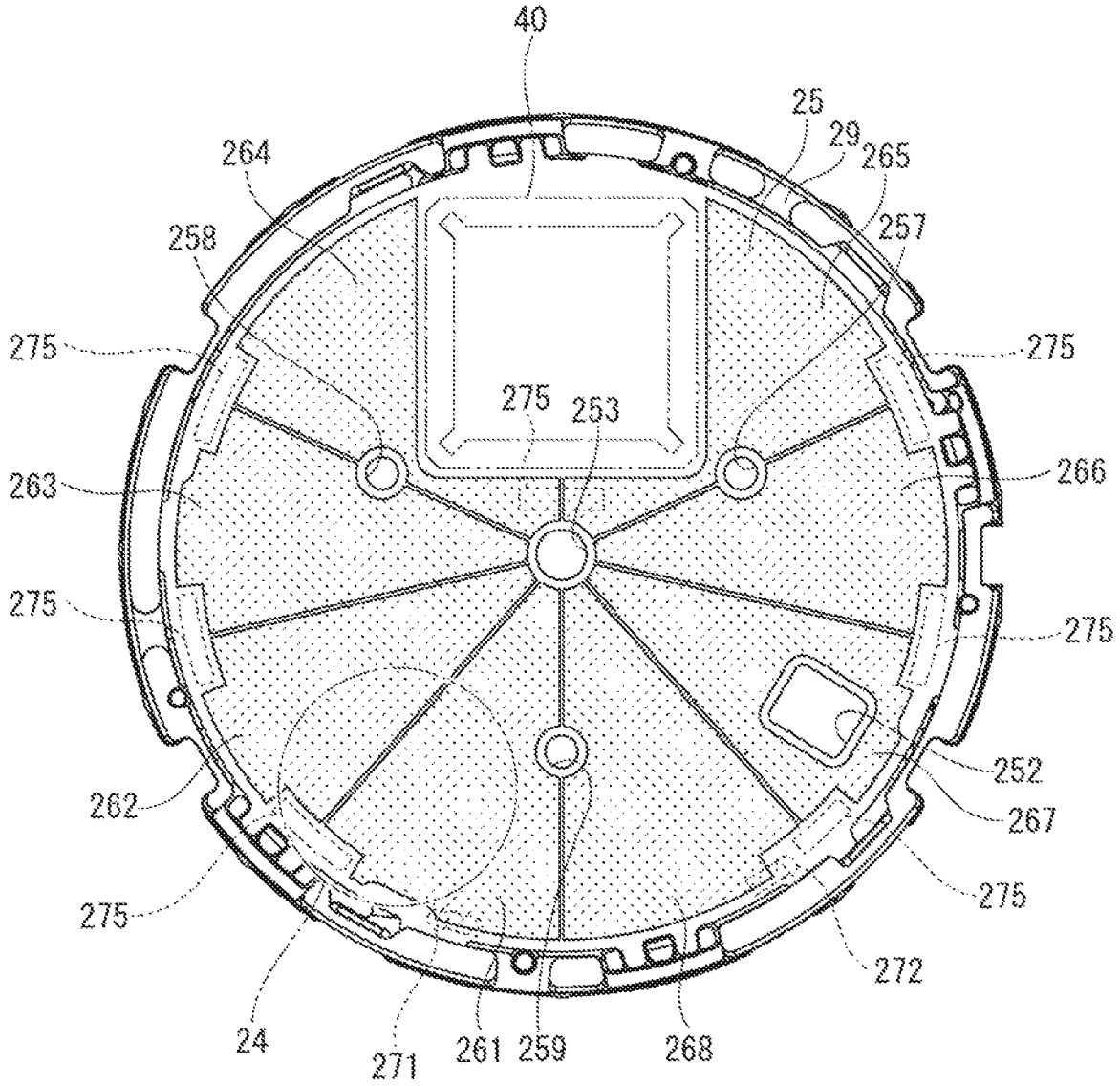
FIG. 6 is a plan view illustrating a solar battery of the electronic timepiece.

As illustrated in FIG. 6, the solar battery panel includes eight solar cells 261 to 268, and electrode terminals 271 and 272 provided on the outer peripheral end portion of the solar battery panel 25. The solar cells 261 to 268 are connected in series between the electrode terminals 271 and 272. That is, each of the solar cells 261 to 268 is connected in series by connecting a metal electrode of one solar cell of adjacent solar cells and a transparent electrode of the other solar cell at each connection portion 275. The electromotive voltage in one solar cell is about 0.6 V or more. For that reason, if eight solar cells 261 to 268 are connected in series, approximately 0.6 V×8 stages=approximately 4.8 V or more. Accordingly, the lithium ion secondary battery 24 having a large electromotive voltage can be charged, and a device with large current consumption such as a GPS reception device (GPS module) can be built in. The number of solar cells is not limited to eight, and may be seven or less, or nine or more. However, if the number of cells is small, the electromotive voltage is lowered and thus, it is necessary to separately provide an up converter circuit. On the other hand, when the number of cells is large, an area of each cell decreases and the generated current decreases. Accordingly, it is preferable that the number of cells is approximately 8.

Figure 7:
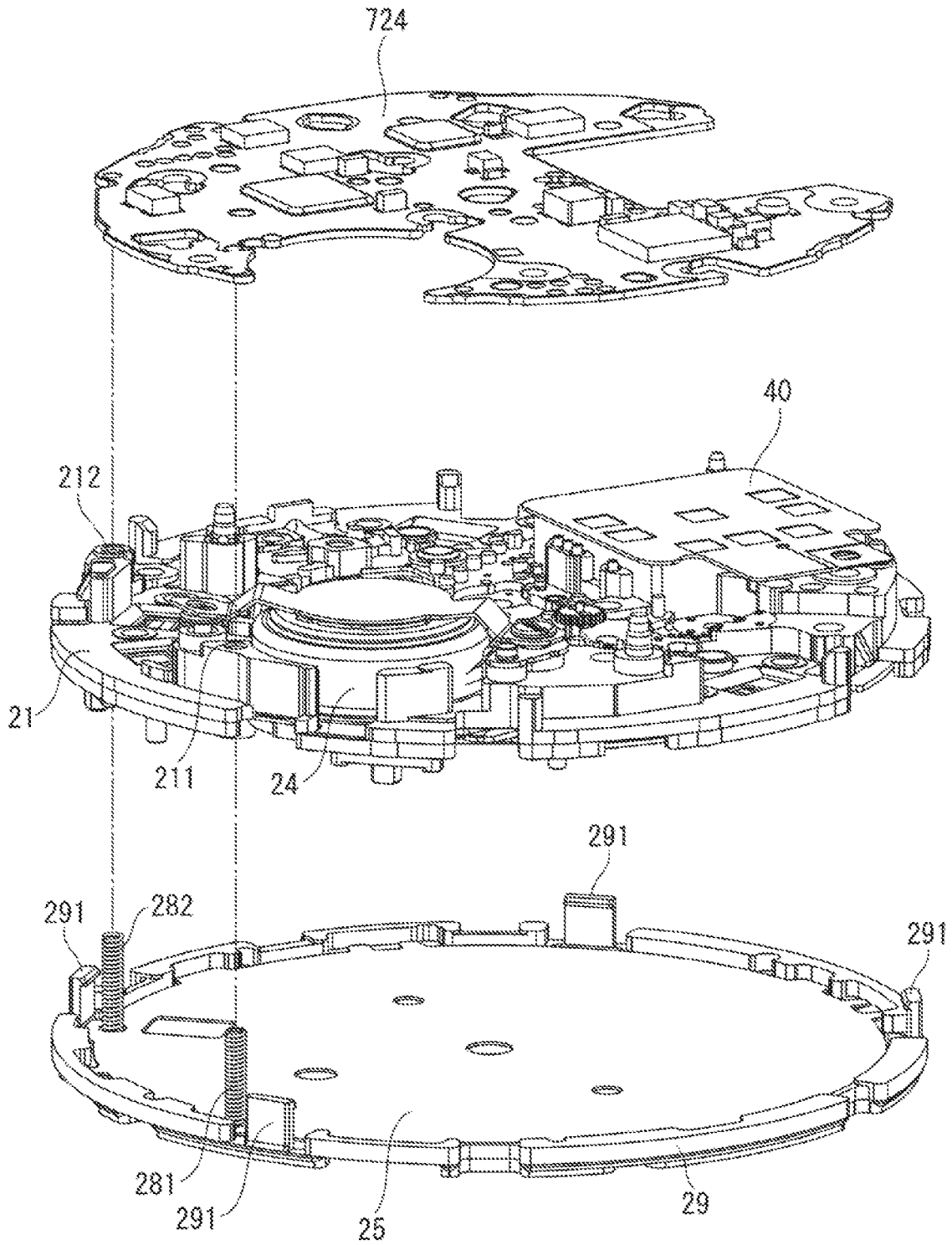
FIG. 7 is another exploded perspective view illustrating the main part of the movement of the electronic timepiece.

The electrode terminal 271 is conducted to one of the metal electrode and the transparent electrode of the solar cell 261, and the electrode terminal 272 is conducted to the other of the metal electrode and the transparent electrode of the solar cell 268. As illustrated in FIGS. 5 and 7, a first conducting spring 281 which is a first conductive member and a second conducting spring 282 which is a second conductive member are disposed between the electrode terminals 271 and 272 and charging terminals 741 and 742 of the second printed circuit board 724.

Figure 8:
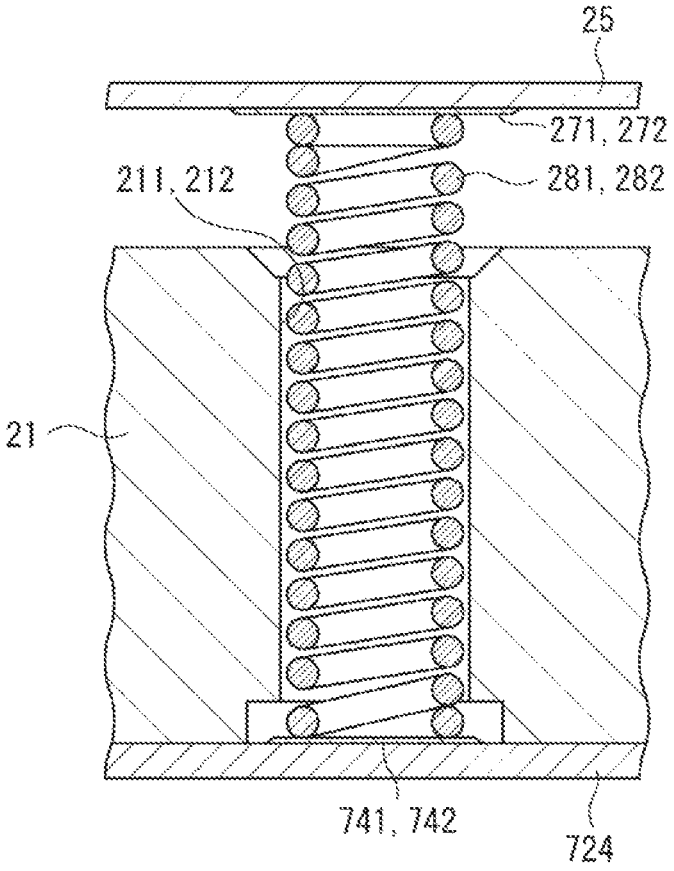
FIG. 8 is a view illustrating a conducting structure between the solar battery and a printed circuit board.

Accordingly, as illustrated in FIGS. 5 and 8, by the current generated by the solar battery panel 25, the secondary battery 24 is charged through the electrode terminals 271 and 272, the conducting springs 281 and 282, and the charging terminals 741 and 742.

The electrode terminal 271 and the electrode terminal 272 are disposed apart from each other in a plan view. That is, the electrode terminal 271 is disposed on the outer periphery of the solar cell 261, and the electrode terminal 272 is disposed on the outer periphery of the solar cell 268. That is, the electrode terminal 271 and the first conducting spring 281 are disposed in the fourth region 108, and the electrode terminal 272 and the second conducting spring 282 are disposed in the third region 107.

Here, in this embodiment, the central angle of the solar cells 261 and 268 is about 40 degrees. For that reason, when the separation distance between the electrode terminals 271 and 272 is represented by the center angle connecting the electrode terminal 271 and the plane center of the solar battery panel 25, that is, the hole 253 in which the hand shaft 3A is disposed and the electrode terminal 272, it is preferable that the central angle is set to be, for example, 40 degrees or more and 80 degrees or less. In the example of FIG. 6, the central angle is approximately 55 degrees.

The electrode terminals 271 and 272 and the conducting springs 281 and 282 are disposed on the outer peripheral side of the date indicator 5 in a plan view, and are concealed by the dial ring 32 which is a cover member as will be described later. Through-holes 211 and 212 through which the conducting springs 281 and 282 are inserted are formed in the main plate 21.

As illustrated in FIGS. 6 and 7, the solar battery panel 25 is attached to the main plate 21 by a solar battery panel holder 29. The solar battery panel holder 29 is a ring member disposed along the outer periphery of the solar battery panel 25, and engagement hooks 291 engaged with the main plate 21 are formed at four places in the circumferential direction thereof. By engaging the solar battery panel holder 29 with the main plate 21 using the engagement hooks 291, the solar battery panel 25 is clamped and fixed by the main plate 21 and the solar battery panel holder 29.

In this case, the electrode terminals 271 and 272 of the solar battery panel 25 are disposed in the vicinity of the engagement hook 291. With this configuration, even if a force for urging the electrode terminals 271 and 272 is applied by the conducting springs 281 and 282, the force can be supported by the engagement hooks 291 of the solar battery panel holder 29, and deformation of the solar battery panel 25 by the conducting springs 281 and 282 can be suppressed.

Date Indicator

In the date indicator disposition portion 21B of the main plate 21, the date indicator 5, which is formed in a ring shape and is a calendar wheel whose date is displayed on the front surface, is disposed. The date indicator 5 is formed of a non-conductive member such as plastic. Here, the date indicator 5 overlaps at least a part of the planar antenna 40 in a plan view. The calendar wheel is not limited to the date indicator 5, but may be a day indicator for displaying the day of the week, a month indicator for displaying the month, or the like.

Dial

On the front surface side of the main plate 21, the dial 2 is disposed so as to cover the front surface side of the solar battery panel 25 and the date indicator 5. The dial 2 is made of a material such as plastic having non-conductivity and having light-transmitting property to transmit at least part of light.

Here, abbreviations and the like can be provided on the front surface of the dial 2 overlapping the planar antenna 40 in a plan view. In this case, in order to improve reception performance of the planar antenna 40, it is preferable that the parts provided on the surface of the dial 2 such as abbreviations are not made of metal, but formed of a non-conductive member such as plastic. On the other hand, a metal part can be used for the third small window 790 or abbreviation which does not overlap the planar antenna 40 in a plan view.

In addition, the dial 2 has a light-transmitting property. For that reason, when viewed from the front surface side of the timepiece by the user, the solar battery panel 25 disposed on the back surface side of the dial 2 can be seen through. For that reason, the color of the dial 2 appears to be different between a region where the solar battery panel 25 is disposed and a region where the solar battery panel 25 is not disposed. The dial 2 may have a design accent so that this color difference is not noticeable.

Furthermore, since the cutout portion 251 is formed in the solar battery panel 25, a color tone of the dial 2 overlapping the cutout portion 251 may appear different from other parts. In order to prevent this, a plastic sheet of the same color (for example, dark blue or purple) as the solar battery panel 25 may be superimposed under the solar battery panel 25, or an electrode layer for blocking radio waves may be removed only in a portion overlapping the planar antenna 40 in a plan view without cutting out the entire solar battery panel 25, and the color tone may be matched while leaving the resin film layer as the base material.

Dial Ring

The dial ring 32 which is a ring member formed of a synthetic resin (for example, ABS resin) which is a nonconductive member is provided on the front surface side of the dial 2. The dial ring 32 is disposed along the periphery of the dial 2, and the inner circumferential surface thereof is formed as an inclined surface (conical surface), and scales such as an hour mark and a time difference of world time are printed on this inclined surface. If the dial ring 32 is molded from plastic, the electronic timepiece 1 can secure the reception performance, and the dial ring 32 can be formed in a complicated shape to improve a design property.

As illustrated in FIG. 3, the dial ring 32 is disposed at a position covering the outer peripheral edges of the dial 2 and the solar battery panel 25. For that reason, the electrode terminals 271 and 272, the connection portion 275 and the conducting springs 281 and 282 of the solar battery panel 25 are disposed at positions overlapping the dial ring 32 in a plan view and are not exposed to the inner peripheral side of the dial ring 32. Accordingly, the dial ring 32 is an example of a cover member.

Planar Antenna

The planar antenna 40 which is a patch antenna (microstrip antenna) is disposed in the antenna accommodation portion 21C of the main plate 21. The planar antenna 40 receives the satellite signal from the GPS satellite S.

The planar antenna 40 does not overlap the case main body 11 (case band 111 and bezel 112), the solar battery panel 25, and the magnetic shield plates 91 and 92 in a plan view and overlaps the date indicator 5, the dial 2, and the cover glass 31 formed of a non-conductive member. That is, in the electronic timepiece 1, all parts overlapping the planar antenna 40 in a plan view are formed of non-conductive members on the timepiece surface side of the planar antenna 40.

For that reason, the satellite signal propagated from the timepiece surface side passes through the cover glass 31, and then is not blocked by the case main body 11, the magnetic shield plates 91 and 92, and the solar battery panel 25, and passes through the dial 2, the date indicator 5, and the main plate 21, and is incident on the planar antenna 40. Since the overlapping area of the second hand 3B, the minute hand 3C, the hour hand 3D, the hand 771, and the hand 781 with the planar antenna 40 is small, even if the second hand 3B, the minute hand 3C, the hour hand 3D, the hand 771, and the hand 781 are made of metal, the second hand 3B, the minute hand 3C, the hour hand 3D, the hand 771, and the hand 781 does not hinder reception of satellite signals, but if the second hand 3B, the minute hand 3C, the hour hand 3D, the hand 771, and the hand 781 are the non-conductive members, the effect of blocking the satellite signals can be avoided more, which is preferable.

The GPS satellites S transmit satellite signals with right-handed circularly polarized waves. For that reason, the planar antenna 40 of this embodiment is configured by a patch antenna having excellent circular polarization characteristics.

Figure 9:
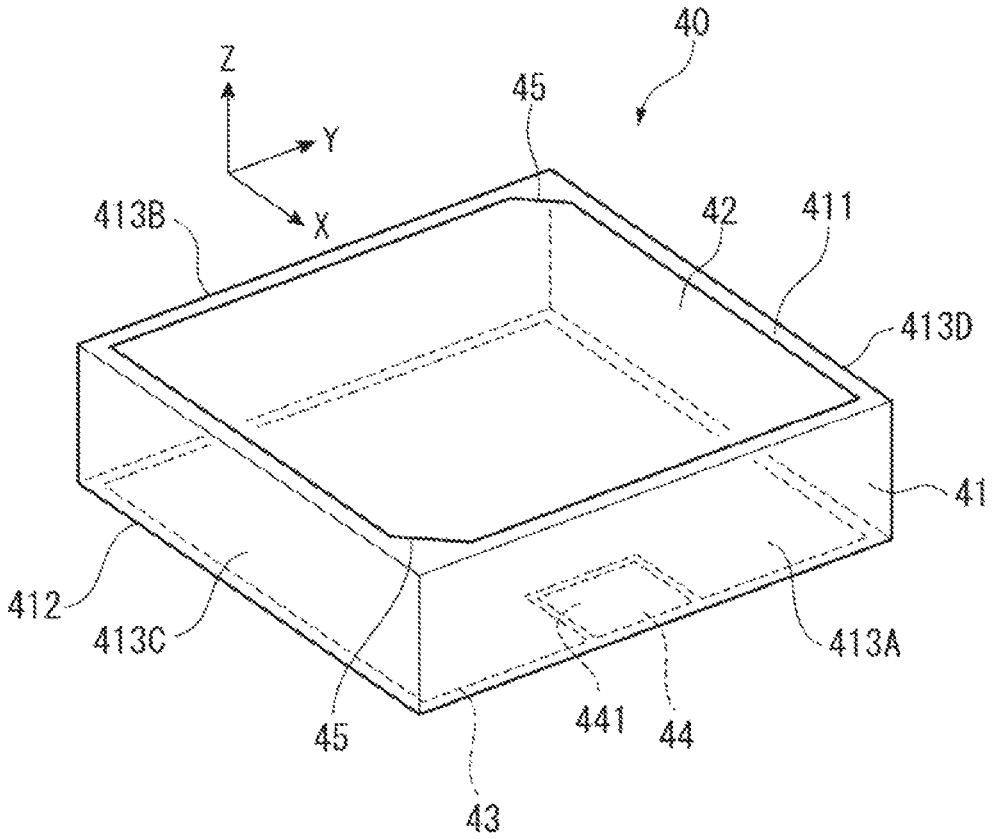
FIG. 9 is a perspective view illustrating a planar antenna to be incorporated in the electronic timepiece.

As illustrated in FIG. 9, the planar antenna 40 is a surface-mounted patch antenna in which an antenna electrode portion 42, a GND electrode 43, and the power feeding portion 44 are disposed on a dielectric base material 41. The power feeding portion 44 includes a power feeding electrode 441 disposed on the bottom surface of the planar antenna 40. The power feeding portion 44 may be a strip-shaped strip electrode having the power feeding electrode 441 and a side-surface electrode continuously provided from the power feeding electrode 441 on the side surface of the planar antenna 40.

In a case where the patch antenna is rectangular, the antenna electrode portion 42 resonates when the length of one side of the antenna electrode portion 42 equal to a half wavelength, and in a case where the patch antenna is circular, the antenna electrode portion 42 resonates when a diameter of the antenna electrode portion 42 is approximately equal to 0.58 wavelength. However, since the planar antenna 40 is provided with the dielectric base material 41, the planar antenna 40 can be downsized by wavelength shortening effect of the dielectric.

The dielectric base material 41 is formed in a rectangular parallelepiped shape by a dielectric such as ceramic. The surface of the dielectric base material 41 on the main plate 21 and the dial 2 side is set as the front surface 411 and the surface on the side of the second printed circuit board 724 is set as the back surface 412. The four side surfaces of the dielectric base material 41 are referred to as a first side surface 413A, a second side surface 413B, a third side surface 413C, and a fourth side surface 413D, respectively. The first side surface 413A and the second side surface 413B are disposed to oppose to each other, and the third side surface 413C and the fourth side surface 413D are disposed to oppose to each other.

On the front surface 411 of the dielectric base material 41, an antenna electrode portion (radiation electrode portion) 42 is formed.

The antenna electrode portion 42 is formed in a rectangular shape in a plan view, and a degenerate separation element portion 45 is formed on a pair of diagonal portions to receive circularly polarized waves. The degenerate separation element portion 45 shifts balance between two orthogonal polarized waves generated in the antenna electrode portion 42, and may be a cutout portion, a protruded portion, or the like. In this embodiment, the degenerate separation element portion 45 is formed by cutting out the corner portions of the antenna electrode portion 42.

The power feeding electrode 441 of the power feeding portion 44 is capacitively coupled with the antenna electrode portion 42 at the center portion of the first side surface 413A. The satellite radio wave received by the antenna electrode portion 42 can be transmitted to the power feeding electrode 441 through capacitive coupling and taken out from the power feeding electrode 441.

The GND electrode 43 is a solid electrode which is insulated from the power feeding electrode 441 and covers the parts except the power feeding electrode 441, on the back surface 412 of the dielectric base material 41.

In this embodiment, a disposition position of the power feeding portion 44 is set as follows.

As illustrated in FIG. 4, a first angular range and a second angular range are virtually set with respect to the center O of the planar antenna 40.

The first angular range is an angular range from the 1.5 o'clock direction to the 4.5 o'clock direction in a case where the direction relative to the center O of the planar antenna 40 is made to correspond to the direction of the scale with respect to the center of the dial 2 (movement 20). Since the 1.5 o'clock direction is an angular direction of 45 degrees with respect to the first straight line 101 and the second straight line 102 that pass through the center of the dial 2, the 1.5 o'clock direction is the direction of an imaginary line 471 directed from the center O of the planar antenna 40 to the corner where the second side surface 413B and the third side surface 413C intersect in FIG. 4. Similarly, the 4.5 o'clock direction is the direction of an imaginary line 472 directed from the center O of the planar antenna 40 to the corner where the second side surface 413B and the fourth side surface 413D intersect.

The second angular range is an angular range from the 7.5 o'clock direction to the 10.5 o'clock direction in a case where the direction relative to the center O of the planar antenna 40 is made to correspond to the direction of the scale with respect to the center of the dial 2 (movement 20). The 7.5 o'clock direction is the direction of an imaginary line 473 directed from the center O of the planar antenna 40 to the corner where the first side surface 413A and the fourth side surface 413D intersect in FIG. 4. The 10.5 o'clock direction is the direction of an imaginary line 474 directed from the center O of the planar antenna 40 to the corner where the first side surface 413A and the third side surface 413C intersect.

Accordingly, the first and second angular ranges are angular ranges in which the central angle is 90 degrees. In this embodiment, the power feeding portion 44 is disposed within the second angular range. More specifically, the power feeding portion 44 is disposed in the 9 o'clock direction with respect to the center O of the planar antenna 40.

The first angular range and the second angular range can also be explained as follows. Consider a plane A parallel to the dial 2 and including the upper surface (front surface) 411 of the planar antenna 40. On the plane A, a plane center O of the planar antenna 40 is set as the origin, and a straight line parallel to the longitudinal direction of the first band 15 and the second band 16 connected to the exterior case 10 and directing from the origin to the first band 15 is set as a reference line 470. The reference line 470 is a straight line with the center O as the origin and overlapping the first straight line 101. The first angular range is a range from 45 degrees to 135 degrees clockwise from the reference line 470 with the origin as the center of rotation. The second angular range is a range from 45 degrees to 135 degrees counterclockwise from the reference line 470 with the origin as the center of rotation. In this embodiment, the power feeding portion 44 is disposed at a position of 90 degrees counterclockwise with respect to the reference line 470.

The planar antenna 40 can be manufactured as follows. First, an intended shape is formed with a pressing machine using barium titanate having a relative dielectric constant of approximately 60 to 120 as a main raw material, and after firing, ceramics to be the dielectric base material 41 of the antenna is completed. On the back surface 412 of the dielectric base material 41, the GND electrode 43 to be a ground electrode of the antenna is configured mainly by screen printing a paste material such as silver (Ag) or the like.

On the front surface 411 of the dielectric base material 41, the antenna electrode portion 42 for determining the frequency of the antenna and polarization of the signal to be received is configured in the same manner as the GND electrode 43. The antenna electrode portion 42 is formed slightly smaller than the surface of the dielectric base material 41. On the surface of the dielectric base material 41, an exposed surface in which the antenna electrode portion 42 is not laminated and from which the dielectric base material 41 is exposed is provided around the antenna electrode portion 42.

The power feeding electrode 441 of the power feeding portion 44 is formed on the back surface 412 of the dielectric base material 41 in the same manner as the GND electrode 43.

For example, the dielectric base material 41 has a substantially square surface shape, the length of one side is approximately 11 mm, and the thickness thereof is 3 mm. For example, the antenna electrode portion 42 has a substantially square surface shape, and the length of one side is approximately 8 to 9 mm.

The planar antenna 40 is mounted on the surface of the second printed circuit board 724, and is electrically connected to the antenna GPS module which is the reception unit 50 mounted on the second printed circuit board 724 through a power feeding line 46. The power feeding line 46 is a wiring formed on the second printed circuit board 724, and in this embodiment, as illustrated in FIG. 4, the power feeding line 46 is wired so as to connect the power feeding portion 44 and the reception unit 50 with a straight line. For that reason, the power feeding line 46 is drawn obliquely from the power feeding electrode 441 of the power feeding portion 44 toward the direction of approximately 8 o'clock. The power feeding line 46 is not limited to the wiring connecting the power feeding portion 44 and the reception unit 50 with a straight line. However, in order to transmit a high frequency signal, it is preferable that the wiring is as close to a line as possible. For that reason, when it is necessary to bend the wiring, the wiring may be bent at an angle of 45 degrees, for example, without being bent at a right angle. This is because when the wiring is bent at a right angle, change in the pattern width of the right angle portion and the pattern width of the straight line portion becomes large, change in the characteristic impedance also becomes large, and is susceptible to noise.

Furthermore, the GND electrode 43 of the planar antenna 40 is electrically conducted to the ground portion of the reception unit 50 through the ground pattern of the second printed circuit board 724, and the second printed circuit board 724 functions as a ground plate (ground plane). Furthermore, the ground portion of the reception unit 50 is electrically conducted to the case band 111 made of metal and the back cover 12 through the ground pattern of the second printed circuit board 724, and the case band 111 and the back cover 12 can also be used as the ground plane.

As illustrated in FIG. 3, the planar antenna 40 is disposed in the antenna accommodation portion 21C by fixing the second printed circuit board 724 to the main plate 21. Since the dielectric base material 41 of the planar antenna 40 is hard and chipped easily with ceramics, a cushioning material 47 such as a sponge is interposed between the dielectric base material 41 and the main plate 21. Accordingly, it is possible to prevent the dielectric base material 41 from colliding with the main plate 21 and being damaged. The cushioning material 47 is not indispensable, and it may be provided as necessary.

Distance Between Antenna Electrode Portion and Metal Part

The operation principle of the patch antenna is that, when the patch antenna is used as a transmitting antenna, a strong electric field along the edge of the patch (antenna electrode portion 42) is radiated from the edge toward a space and thus lines of electric force in the vicinity of the antenna become stronger, and are susceptible to the influence of nearby metals and dielectrics. Particularly, the influence of the metal parts positioned above the antenna electrode portion 42 (on the cover glass 31 side) is large.

For that reason, a positional relationship between the metal part disposed on the upper side (cover glass 31 side) than the upper surface (antenna electrode portion 42) of the planar antenna 40 and the antenna electrode portion 42 is set as follows.

In this embodiment, the metal parts disposed above the upper surface of the planar antenna 40 is the electrode parts of the case main body 11 (case band 111) of the exterior case 10, the first magnetic shield plate 91, and the solar battery panel 25.

As illustrated in FIG. 3, the shortest distance between the antenna electrode portion 42 and the case main body 11 is set as D1, the shortest distance between the antenna electrode portion 42 and the first magnetic shield plate 91 disposed on the back surface of the dial 2 is set as D2, and the shortest distance between the antenna electrode portion 42 and the electrode portion of the solar battery panel 25 is set as D3. Further, the thickness of the planar antenna 40 is set as t.

The D1 to D3 described above were set based on experimental examples confirming the influence on reception characteristics depending on the distance between the antenna electrode portion 42 and the metal part. In this embodiment, the shortest distances D1 to D3 are set to be at least 2.4 mm or more which is 80% of the thickness (t=3 mm) of the planar antenna 40.

Operational Effect of Embodiment

In a plan view of the electronic timepiece 1, since the step motors 221 to 225, the secondary battery 24, and the planar antenna 40 are disposed so as not to overlap each other, the thickness of the electronic timepiece 1 can be thinned.

Since the planar antenna 40 is disposed in one region (first region 105 and second region 106) and the conducting springs 281 and 282 are disposed in the other region (third region 107 and fourth region 108) when the plane region of the dial 2 is divided into two regions by the second straight line 102, the conducting springs 281 and 282 can be disposed apart from the planar antenna 40. In particular, a dimension between the planar antenna 40 and each of the conducting springs 281 and 282 can be made several times larger than the dimension D1 between the planar antenna 40 and the exterior case 10. For that reason, the influence of the conducting springs 281 and 282 on the planar antenna 40 can be reduced, and deterioration in reception performance can be prevented.

Furthermore, the first conducting spring 281 and the second conducting spring 282 are disposed in the third region 107 and the fourth region 108, respectively. That is, since the first conducting spring 281 and the second conducting spring 282 are disposed with a space therebetween, the influence on the directivity characteristics of the planar antenna 40 can be distributed as compared with the case where the first conducting spring 281 and the second conducting spring 282 are disposed adjacent to each other, so that it is possible to easily receive radio waves from all directions.

In addition, since the first conducting spring 281 and the second conducting spring 282 are disposed with a space therebetween, the load applied to the solar battery panel 25 by the conducting springs 281 and 282 can be distributed. That is, in a case where the two conducting springs 281 and 282 are disposed adjacent to each other, since two springs abut on one position of the solar battery panel 25, a large force is applied to the solar battery panel 25. For that reason, it is necessary to increase the thickness of the solar battery panel holder 29 or increase the number of the engagement hooks 291 so that the solar battery panel holder 29 can support the force of the conducting springs 281 and 282. In contrast, if the conducting springs 281 and 282 are disposed with a space therebetween as in this embodiment, the load applied to the solar battery panel 25 can be distributed, the solar battery panel holder 29 can be thinned, and the number of engagement hook 291 can also be minimized.

In particular, in the embodiment described above, since each of the conducting springs 281 and 282 is disposed in the vicinity of the engagement hook 291, the force of the conducting springs 281 and 282 can be effectively supported.

In addition, since the electrode terminals 271 and 272 of the solar battery panel 25 are disposed at a position overlapping the dial ring 32, which is a cover member in a plan view, that is, on the outer peripheral edge of the solar battery panel 25, the conducting springs 281 and 282 can be disposed on the dial 2 and the outer peripheral portion of the main plate 21. For that reason, the degree of freedom in designing the movement 20 can be improved. That is, the conducting springs 281 and 282 are disposed from the solar battery panel 25 to the second printed circuit board 724, and are parts whose a thickness dimension in the timepiece is large among the timepiece parts. For that reason, if the conducting springs 281 and 282 are disposed in a region inside the outer peripheral edge of the solar battery panel 25, there is a possibility of interference with the date indicator 5, the train wheel, and the like, and the disposition of the date indicator, the train wheel, and the like is restricted. In contrast, according to the configuration of this embodiment, since the conducting springs 281 and 282 are disposed on the outer peripheral portion of the main plate 21, the date indicator 5 and train wheel can be freely disposed as long as they are inside the conducting springs 281 and 282. With this configuration, the degree of freedom in designing the movement 20 can be improved.

The electrode terminals 271 and 272 of the solar battery panel 25 can be concealed by the dial ring 32. Even in the case where the electrode terminals 271 and 272 becomes black and conspicuous as compared with other places of the solar battery panel 25 due to the conducting springs 281 and 282 being disposed on the back side or the like, the electrode terminals 271 and 272 are not exposed in the appearance by being hidden with the dial ring 32, so that it is possible to easily realize the high-quality electronic timepiece 1.

Since the planar antenna 40 is disposed in one of the two regions divided by the second straight line 102 and the secondary battery 24 is disposed in the other, the planar antenna 40 and the secondary battery 24 can be disposed apart from each other. For that reason, the influence of the secondary battery 24 can be suppressed, and reception sensitivity of the planar antenna 40 can be improved.

Since the power feeding portion 44 and the reception unit 50 of the planar antenna 40 are disposed in the first region 105, the power feeding line 46 connecting the power feeding portion 44 and the reception unit 50 can be shortened, and the influence of noise can be reduced.

Since the second magnetic shield plate 92, the step motors 221 to 225, and the crystal oscillator 63 are not disposed in the first region 105 where the reception unit 50 is disposed, the influence of metal parts on the power feeding line 46 can be reduced and sensitivity deterioration of the planar antenna 40 can be suppressed.

Furthermore, since the power feeding line 46 is drawn from the power feeding portion 44 in an oblique direction and the power feeding line 46 is linearly wired to the reception unit 50, the change in characteristic impedance can be suppressed and the influence of noise on the power feeding line 46 can be minimized.

Since the planar antenna 40 is disposed in the direction of 12 o'clock from the center of the dial 2 and the power feeding portion 44 is disposed in the direction of 9 o'clock from the center of the planar antenna 40, the power feeding portion 44 can be disposed away from the exterior case 10.

For that reason, the influence of the metal case main body 11 on the planar antenna 40 can be reduced, and the reception sensitivity of the planar antenna 40 can be improved.

Since the planar antenna 40 is configured by a patch antenna, it is possible to cause the second printed circuit board 724 to function as a ground plate, and to reflect the radio waves incident from the outside on the second printed circuit board 724 and guide the radio waves to the planar antenna 40, and the reception performance of the planar antenna 40 can be further improved.

Since the case band 111 and the back cover 12 are connected to the ground portion of the reception unit 50, the case band 111 and the back cover 12 function as a ground plane. With this configuration, an area of the ground plane can be increased, the antenna gain is improved, and the antenna characteristics can be improved.

Since the planar antenna 40 does not overlap the solar battery panel 25 and the magnetic shield plates 91 and 92 in a plan view, the satellite signal propagated from the front surface side of the timepiece is incident on the planar antenna 40 without being blocked by the solar battery panel 25 and the magnetic shield plate 91. For that reason, it is possible to provide the solar battery panel 25 and the magnetic shield plates 91 and 92 in the electronic timepiece 1 without deteriorating the reception performance.

Since the planar antenna 40 is disposed in the direction of 12 o'clock from the center of the dial 2, the planar antenna 40 does not interfere with the hand shafts 4B, 4C, and 4D of the hands 771, 781, and 791 of the first small window 770, the second small window 780, and the third small window 790. For that reason, it is possible to reduce restrictions on the design of the dial 2 of the electronic timepiece 1.

Since the eight solar cells 261 to 268 are connected in series in the solar battery panel 25, an electromotive voltage of approximately 4.8 V or more can be obtained and the secondary battery 24 of lithium ion having a large electromotive voltage can be charged. For that reason, it is possible to configure the electronic timepiece 1 in which a device such as a GPS receiver (GPS module) which consumes a large current is built in.

In the planar antenna 40, since the power feeding portion 44 is configured by the power feeding electrode 441, the planar antenna 40 can be made thinner than the power feeding portion using a power feeding pin, and the planar antenna 40 can be easily manufactured by surface mounting. In addition, if a power feeding pin is provided in the vicinity of an end (a position biased with respect to the center of the antenna) of the planar antenna 40, the dielectric base material 41 made of ceramic may be broken in some cases, but cracking of the dielectric base material 41 can also be prevented by not using pins.

Since the shortest distance Dl from the antenna electrode portion 42 to the metal case main body 11, the shortest distance D2 from the antenna electrode portion 42 to the first magnetic shield plate 91, the shortest distance D3 from the antenna electrode portion 42 to the electrode portion of the solar battery panel 25 are respectively set to 80% or more of the thickness t of the planar antenna 40, the frequency shift can be eliminated and the influence on the reception sensitivity of the planar antenna 40 can be reduced.

Since the planar antenna 40 can be disposed without overlapping the step motors 221 to 225 and the secondary battery 24 in a plan view, the planar antenna 40 can be configured by stacking the dielectric base material 41. For this reason, even if the planar antenna 40 having a small planar size is used in order to incorporate the planar antenna 40 into the electronic timepiece 1 of the wristwatch size, the reception performance can be secured. The planar antenna 40 planarly overlaps the dial 2, but the dial 2 is made of a nonconductive member, so that the reception performance with the planar antenna 40 can be secured. Even in a case where the hand 3 is configured by a conductive member, the hand has a needle shape and a plane region thereof is small, so that the influence on the reception performance can be minimized.

Accordingly, it is possible to provide the electronic timepiece 1 that can secure the reception performance and can be thinned and suitable for a wristwatch.

At the 3 o'clock position of the dial 2 in a plan view, switching mechanism such as the winding stem 706 and a setting lever is disposed, if the planar antenna 40 or the secondary battery 24, which is a relatively large parts among the timepiece parts, is disposed at the 3 o'clock position, it is necessary to enlarge a plane size of the electronic timepiece 1. In contrast, in this embodiment, since the planar antenna 40 and the secondary battery 24 are disposed avoiding the 3 o'clock position, the plane size of the electronic timepiece 1 can be reduced without allowing the planar antenna 40 and the secondary battery 24 to interfere with the switching mechanism disposed at the 3 o'clock position.

Since the secondary battery 24 is disposed in the cutout portion 731 of the second printed circuit board 724, the thickness of the electronic timepiece 1 can be thinned and the thickness of the electronic timepiece 1 can be reduced as compared with the case where the battery is disposed on the back surface side of the second printed circuit board 724.

Since a part of the exterior case 10, for example, the case band 111, the bezel 112, and the back cover 12 can be made of metal, the texture of the electronic timepiece 1 can be improved. Furthermore, since a ring member such as the dial ring 32 disposed along the outer periphery of the dial 2 is configured by a non-conductive member, the planar antenna 40 can receive the satellite signal from the cover glass 31 side of the timepiece through the dial 2, the dial ring 32 and the main plate 21, even if the case band 111, the bezel 112, and the back cover 12 are made of metal, the reception performance can be secured.

Since the date indicator 5 is configured by a non-conductive member, even if the date indicator 5 is disposed to overlap the planar antenna 40 in a plan view, the satellite signal passes through the date indicator 5 and is incident on the antenna and thus, it is possible to prevent the reception performance from deteriorating.

Since the date indicator 5 overlaps the planar antenna 40 in a plan view, the degree of freedom of the disposition position of the hand shafts 3A, 4B, 4C, and 4D of the hands 3, 771, 781, and 791 disposed avoiding the date indicator 5 and the planar antenna 40 is increased, and the design freedom of the electronic timepiece 1 can be improved.

Another Embodiment

The invention is not limited to each embodiment described above, and various modifications can be made thereto within the scope of the gist of the invention.

Figure 10:
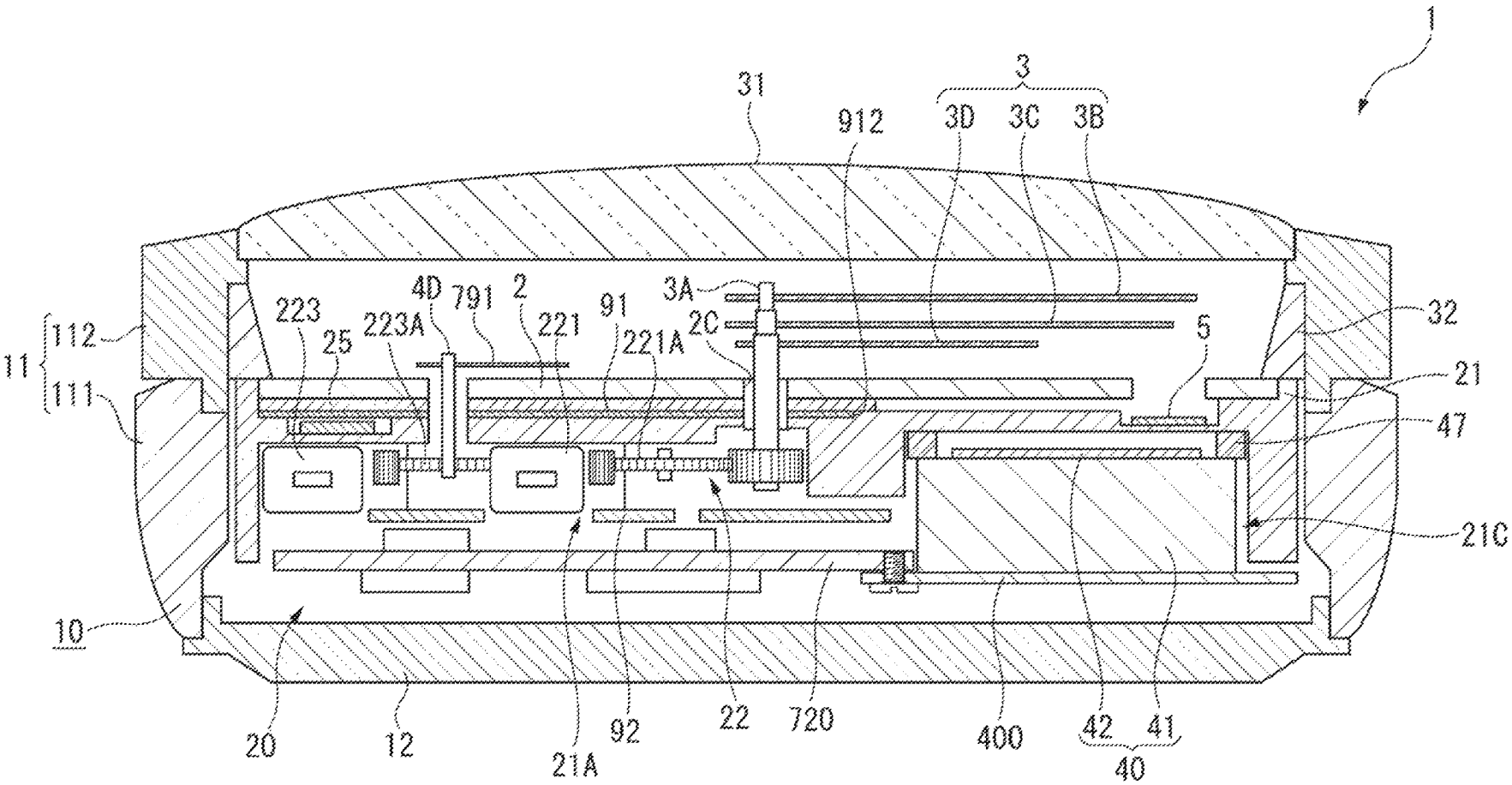
FIG. 10 is a cross-sectional view of an electronic timepiece according to a modification example.

As illustrated in FIG. 10, an antenna board 400 on which the planar antenna 40 is mounted and a main board 720 may be separated from each other. In the antenna board 400, only the planar antenna 40 is mounted. The main board 720 is a double-sided mounting printed circuit board, and various ICs and the like are mounted on both sides thereof.

If the antenna board 400 and the main board 720 are formed as separate bodies, the planar antenna 40 and the main board 720 can be disposed in parallel. That is, since only the planar antenna 40 is mounted on the antenna board 400, the number of layers of the board can be reduced and the antenna board 400 can be thinned. On the other hand, since the main board 720, for example, is configured by, for example, a six-layer board, and ICs and the like are mounted on both sides of the main board 720, the thickness of the main board 720 becomes thicker than the antenna board 400. Accordingly, if the main board 720 and the antenna board 400 are formed as separate bodies, the main board 720 can be disposed within the thickness of the planar antenna 40 in the timepiece thickness direction. For that reason, it is possible to reduce the thickness of the electronic timepiece 1 while securing the thickness of the planar antenna 40.

The disposition position of the planar antenna 40 in the exterior case 10 is not limited to the 12 o'clock direction side with respect to the center of the dial 2 but may be in the 6 o'clock direction side, that is, within an angular range in which the center position of the planar antenna 40 is located in a range from the 5 o'clock direction to the 7 o'clock direction with respect to the plane center of the exterior case 10. Furthermore, the disposition position of the planar antenna 40 is located on the 3 o'clock direction side (center position of the planar antenna 40 is within an angular range from the 2 o'clock direction to the 4 o'clock direction) with respect to the center of the dial 2 and the 9 o'clock direction side (center position of the antenna 40 is within an angular range from the 8 o'clock direction to the 10 o'clock direction) with respect to the center of the dial 2. That is, the position of the planar antenna 40 may be appropriately set according to the structure of the movement 20.

The conducting springs 281 and 282 may be disposed in a region different from a region where the planar antenna 40 is disposed when the dial 2 is divided into two regions in a plan view.

Further, a power feeding pin may be used as the power feeding portion of the planar antenna 40.

In the embodiment described above, the bezel 112 is formed of a conductive member, but the invention is not limited thereto. For example, the bezel 112 may be made of ceramic such as zirconia ($ZrO_2$) which is a nonconductive member. Zirconia has high resistivity and not only does not adversely affect radio wave reception, but also is excellent in scratch resistance as well as hard, and thus it is excellent as an exterior member of a timepiece. If the bezel 112 is made of ceramic, the bezel 112 can be overlapped with the antenna electrode portion 42 in a plan view. For that reason, since it is unnecessary to enlarge the diameter of the case band 111 so that the bezel 112 does not overlap the antenna electrode portion 42 in a planar manner, the diameter of the case band 111 can be reduced, the planar size of the electronic timepiece 1 can be reduced.

In the embodiment described above, the electronic timepiece 1 includes the date indicator 5, the solar battery panel 25, and the dial ring 32, but the invention is not limited thereto. That is, the electronic timepiece 1 may not include the date indicator 5, the solar battery panel 25, and the dial ring 32. In this case, the cover member may be configured by a case bezel. Furthermore, a cover member for covering the electrode terminals 271 and 272 of the solar battery panel 25 is not necessarily provided.

In the embodiment described above, although, in the solar battery panel 25, the cutout portion 251 is formed in a portion overlapping the planar antenna 40 in a plan view, the solar battery panel 25 is not limited to one in which the cutout portion 251 is formed. The solar battery panel 25 may be configured so as not to affect the reception of radio waves by the planar antenna 40 and may be any shape as long as the solar battery panel 25 is not disposed in a portion overlapping the planar antenna 40 in a plan view. For example, an opening obtained by hollowing out only the portion overlapping the planar antenna 40 in a plan view may be formed in the solar battery panel 25, or the solar battery panel 25 may be formed in a semicircular shape so as not to dispose the solar battery panel in the portion overlapping the planar antenna 40 in a plan view.

In the embodiment described above, although the first magnetic shield plate 91 and the second magnetic shield plate 92 are cut out to form the cutout portions 912 and 922, the first magnetic shield plate and the second magnetic shield plate are not limited to those having cutout portions formed therein. That is, in consideration of the influence on reception, the shapes of the first magnetic shield plate 91 and the second magnetic shield plate 92 may be set so that the distance from the planar antenna 40 becomes appropriate.

Although the GPS satellite S has been described as an example of the positioning information satellite, but is not limited thereto. For example, as the positioning information satellite, satellites used in other global terrestrial navigation satellite systems (GNSS) such as Galileo (EU), GLONASS (Russia), Beidou (China) can be applied. A geostationary satellite such as a geosynchronous satellite navigation reinforcement system (SBAS) and a satellite such as a regional satellite positioning system (RNSS) that can be searched only in a specific region such as a quasi-zenith satellite can also be applied.

The planar antenna 40 is not limited to the patch antenna described above but may be another type of planar antenna such as a chip antenna or an inverted F antenna, and an appropriate planar antenna may be used according to the type of the received signal.

The entire disclosure of Japanese Patent Application No. 2018-056515, filed Mar. 23, 2018 is expressly incorporated by reference herein.

What is claimed is:

1. An electronic timepiece comprising:

an exterior case having a back cover;

a hand accommodated in the exterior case;

a dial accommodated in the exterior case;

a solar battery accommodated in the exterior case and disposed between the dial and the back cover;

a planar antenna accommodated in the exterior case and disposed between the dial and the back cover;

a plurality of electric motors accommodated in the exterior case, disposed so as not to overlap the planar antenna in a plan view when viewed in a direction perpendicular to the dial, and driving the hand;

a secondary battery accommodated in the exterior case, disposed so as not to overlap the planar antenna and the plurality of electric motors in the plan view, and charged by the solar battery;

a printed circuit board accommodated in the exterior case and disposed between the solar battery and the back cover; and a first conductive member and a second conductive member that connect the solar battery and the printed circuit board to each other, and are disposed spaced apart from each other, wherein the dial is divided into a first region and a second region by an imaginary line passing through a plane center position of the dial, the planar antenna is disposed in the first region, and the first conductive member and the second conductive member are disposed in the second region.

2. The electronic timepiece according to claim 1, wherein the first conductive member and the second conductive member are disposed such that an angle between the first conductive member and the second conductive member with respect to the plane center position in the plan view is 40 degrees or more and 80 degrees or less.

3. The electronic timepiece according to claim 1, wherein the secondary battery is disposed in a region different from a region where the planar antenna is disposed, in the plan view.

4. The electronic timepiece according to claim 1, wherein, in the plan view, when the plane region of the dial is divided into four regions of a first region to a fourth region with a first imaginary straight line and a second imaginary straight line passing through the plane center position of the dial and orthogonal to each other, the planar antenna is disposed so as to overlap the adjacent first region and second region, the first conductive member is disposed in the third region, and the second conductive member is disposed in the fourth region.

5. The electronic timepiece according to claim 4, wherein the first region is disposed in a range of 9 o'clock to 12 o'clock of the dial, the second region is disposed in a range of 12 o'clock to 3 o'clock of the dial, the third region is disposed in a range of 3 o'clock to 6 o'clock of the dial, and the fourth region is disposed in a range of 6 o'clock to 9 o'clock of the dial.

6. The electronic timepiece according to claim 4, wherein the planar antenna includes a power feeding portion disposed in the first region in the plan view, and a reception IC for the planar antenna is disposed in the first region in the plan view.

7. The electronic timepiece according to claim 1, wherein the planar antenna is a patch antenna.

8. The electronic timepiece according to claim 1, wherein the solar battery includes eight or more cells connected in series.

9. The electronic timepiece according to claim 1, further comprising:

a cover member that covers an outer periphery of the dial in the plan view, wherein the first conductive member and the second conductive member are disposed respectively at positions overlapping the cover member in the plan view.

* * * * *